US008221954B2

(12) United States Patent
Xie et al.

(10) Patent No.: US 8,221,954 B2
(45) Date of Patent: Jul. 17, 2012

(54) COLOR TONER AND METHOD FOR PREPARING THE SAME

(75) Inventors: Xiaolin Xie, Wuhan (CN); Guilin Xiao, Wuhan (CN); Wenbu Li, Wuhan (CN); Zeguan Lan, Wuhan (CN)

(73) Assignee: Hubei Dinglong Chemical Co., Ltd., Wuhan (CN)

( * ) Notice: Subject to any disclaimer, the term of this patent is extended or adjusted under 35 U.S.C. 154(b) by 60 days.

(21) Appl. No.: 12/832,100

(22) Filed: Jul. 8, 2010

(65) Prior Publication Data

US 2011/0104606 A1 May 5, 2011

Related U.S. Application Data

(63) Continuation-in-part of application No. PCT/CN2010/072419, filed on May 4, 2010.

(30) Foreign Application Priority Data

Oct. 29, 2009 (CN) ..... 2009 1 0272567
Oct. 29, 2009 (CN) ..... 2009 1 0272568

(51) Int. Cl.
*G03G 9/08* (2006.01)

(52) U.S. Cl. ..... 430/137.14; 430/137.17

(58) Field of Classification Search ..... 430/137.14, 430/137.17

See application file for complete search history.

(56) References Cited

U.S. PATENT DOCUMENTS 5,591,556 A * 1/1997 Shimomura et al. ..... 430/110.1
5,965,316 A * 10/1999 Kmiecik-Lawrynowicz et al. ..... 430/137.14

* cited by examiner

*Primary Examiner* — Janis L Dote
(74) *Attorney, Agent, or Firm* — Matthias Scholl P.C.; Matthias Scholl

(57) ABSTRACT

A method of preparing a color toner by: a) preparing an anionic polymer composite emulsion comprising wax with a wax particle and nanosilica as core by in situ emulsion polymerization; b) preparing a cationic polymer composite emulsion comprising colorant with a colorant and nanosilica as core by in situ emulsion polymerization; c) agglutinating the anionic polymer composite emulsion comprising wax and the cationic polymer composite emulsion comprising colorant; and d) filtering, washing, and drying the product obtained in c). The color toner prepared by this method. The color toner has high development density, high resolution, low bottom ash, low waste rate, and low consumption, and is easy to recover and recycle.

8 Claims, No Drawings

COLOR TONER AND METHOD FOR PREPARING THE SAME

CROSS-REFERENCE TO RELATED APPLICATIONS

This application is a continuation-in-part of International Patent Application No. PCT/CN2010/072419 with an international filing date of May 4, 2010, designating the United States, now pending, and further claims priority benefits to Chinese Patent Application No. 200910272567.3 filed Oct. 29, 2009, and to Chinese Patent Application No. 200910272568.8 filed Oct. 29, 2009. The contents of all of the aforementioned applications, including any intervening amendments thereto, are incorporated herein by reference.

BACKGROUND OF THE INVENTION

1. Field of the Invention

The invention relates to a color toner and a method for preparing the same.

2. Description of the Related Art

Color toner, mainly consisting of resin, pigment, and additive, is an important material for color laser printing and color digital copying. Conventional methods for preparing a color toner involve melting and mixing a resin (mainly a copolymer of styrene-butyl acrylate), a colorant (a pigment or a dye), and an additive (a charge regulator or a release agent), grinding the mixture mechanically at low temperature, further grinding by gas flow, and grading to yield a color toner with a particle size of about 10 μm. The methods have difficulty in uniformly dispersing the colorant in the resin, and the resultant toner particles are big and their size and shape are not uniform. Thus, upon printing or copying, the resolution is low, the color is poor, the rate of waste toner is high, and the color toner is easy to stick to rollers.

The suspension polymerization method developed by Canon Co., Ltd. can effectively control the particle size of color toner, improve the flow and charging properties, enhance the fixation stability and consolidation properties, and inhibit print through. However, the resultant toner has a wide particle size distribution, and upon printing or copying, the resolution is low and the color is poor. In addition, the toner is too round in shape, which makes it very difficult to recycle and clean the residual toner on a photoreceptor.

The emulsion polymerization/co-flocculation method developed by Fuji Xerox and Konica-Minolta can narrow the particle size of color toner to 5 μm or even a nano level by regulating a surfactant and shear rate and control the shape of color toner by controlling flocculation and heat treatment, whereby improving the resolution and color of printing and copying. The resultant toner is non-spherical, which makes it easy to recycle and clean the residual toner on a photoreceptor. However, in the process of mixing, flocculating, and heating the polymer emulsion and the colorant emulsion, the resin particles and the colorant particles are hard to disperse uniformly and hard to bind to each other. On the other hand, to improve the anti-partial printing properties, a large amount of wax is required, which easily causes wax to transfer to the surface of toner to pollute the carrier and developing sleeve. Furthermore, excess wax causes the uneven distribution of pigment in the toner, whereby resulting in a poor quality of printing and copying.

SUMMARY OF THE INVENTION

In view of the above-described problems, it is one objective of the invention to provide a method of preparing a color toner that exhibits good color and high resolution during printing and copying and is easy to recycle and clean.

It is another objective of the invention to provide a color toner that exhibits good color and high resolution during printing and copying and is easy to recycle and clean.

To achieve the above objectives, in accordance with one embodiment of the invention, there is provided a method of preparing a color toner that exhibits good color and high resolution during printing and copying and is easy to recycle and clean, the method comprising steps of:

a) preparing an anionic polymer composite emulsion comprising wax with a wax particle and nano-silica as core by in situ emulsion polymerization;
b) preparing a cationic polymer composite emulsion comprising colorant with a colorant and nano-silica as core by in situ emulsion polymerization;
c) agglutinating the anionic polymer composite emulsion comprising wax and the cationic polymer composite emulsion comprising colorant; and
d) optionally, filtering, washing, and drying a product of step c).

In accordance with another embodiment of the invention, there is provided a color toner that exhibits good color and high resolution upon printing and copying and is easy to recycle and clean, wherein the color toner is prepared following the steps of:

a) preparing an anionic polymer composite emulsion comprising wax with a wax particle and nano-silica as core by in situ emulsion polymerization;
b) preparing a cationic polymer composite emulsion comprising colorant with a colorant and nano-silica as core by in situ emulsion polymerization;
c) agglutinating the anionic polymer composite emulsion comprising wax and the cationic polymer composite emulsion comprising colorant; and
d) optionally, filtering, washing, and drying a product of step c).

In a class of this embodiment, the anionic polymer composite emulsion comprising wax and the cationic polymer composite emulsion comprising colorant are agglutinated using an impinging stream mixer.

Theoretically, the impinging stream mixer makes currents collide to form a high frequency eddy current so that different materials are mixed completely. Specifically, in the presence of a nonionic surfactant, the anionic polymer composite emulsion comprising wax and the cationic polymer composite emulsion comprising colorant are first agglutinated by the interaction of positive charge and negative charge under the action of impinging stream, in which no flocculant is needed, and then are treated by heat, filtered, dried, and mixed with an additive to yield a color toner.

In a class of this embodiment, the anionic polymer composite emulsion comprising wax is prepared in the presence of an anionic surfactant.

In a class of this embodiment, the cationic polymer composite emulsion comprising colorant is prepared in the presence of a cationic surfactant.

In a class of this embodiment, the anionic polymer composite emulsion comprising wax and the cationic polymer composite emulsion comprising colorant are agglutinated in the presence of a nonionic surfactant.

In a class of this embodiment, during the process of in situ emulsion polymerization, a monomer and an initiator are added to a continuous phase, such as water, and then nano-silica is added to form a dispersed phase of nano-silica. Because the monomer is slightly soluble in the aqueous phase, and the polymer is insoluble in the whole system, therefore, a polymerization reaction with nano-silica and wax (or colorant) as the core happens. In the early stage, the monomer is polymerized into a prepolymer. The prepolymer is further polymerized until a desired particle size is obtained. In the process, as a filler silica and wax (or colorant) are directly added to the liquid monomer at the polymerization state, so silica and wax (or colorant) are dispersed uniformly. Thus, the resolution and color upon printing and copying have been improved greatly, and no extra wax is needed, which prevents wax from transferring to the surface of toner to pollute the carrier and developing sleeve, and avoids the uneven distribution of pigment in the toner. In addition, the color toner is non-spherical, the sphericity thereof is controlled at between 0.94 and 0.99 (particularly, 0.94, 0.95, 0.96, 0.97, 0.98, or 0.99), its size and shape are basically uniform. Thus, they are not prone to stick to a photoreceptor and easy to recovery and clean.

Both the anionic polymer composite emulsion comprising wax and the cationic polymer composite emulsion comprising colorant have nano-silica. The ball effect of the nano-silica reduces the melt viscosity of toner upon printing and copying, which is beneficial to improve color. Meanwhile, the nano-silica can also function as an intensifier and a thixotropic agent, which is beneficial to improve resolution. The particle size of the nano-silica is preferably between 10 and 100 nm (particularly 10, 15, 20, 25, 30, 35, 40, 45, 50, 55, 60, 65, 70, 75, 80, 85, 90, 95, or 100 nm), and the corresponding usage amount thereof is between 0.5 and 5 wt. % of the anionic polymer composite emulsion (particularly 0.5, 0.6, 0.7, 0.8, 0.9, 1.0, 1.1, 1.2, 1.3, 1.4, 1.5, 1.6, 1.7, 1.8, 1.9, 2.0, 2.1, 2.2, 2.3, 2.4, 2.5, 2.6, 2.7, 2.8, 2.9, 3.0, 3.1, 3.2, 3.3, 3.4, 3.4, 3.5, 3.6, 3.7, 3.8, 3.9, 4.0, 4.1, 4.2, 4.3, 4.4, 4.5, 4.6, 4.7, 4.8, 4.9, or 5.0 wt %) comprising wax or between 0.5 and 5 wt. % (particularly 0.5, 0.6, 0.7, 0.8, 0.9, 1.0, 1.1, 1.2, 1.3, 1.4, 1.5, 1.6, 1.7, 1.8, 1.9, 2.0, 2.1, 2.2, 2.3, 2.4, 2.5, 2.6, 2.7, 2.8, 2.9, 3.0, 3.1, 3.2, 3.3, 3.4, 3.4, 3.5, 3.6, 3.7, 3.8, 3.9, 4.0, 4.1, 4.2, 4.3, 4.4, 4.5, 4.6, 4.7, 4.8, 4.9, or 5.0 wt %) of the cationic polymer composite emulsion comprising colorant. Upon agglutination, the usage amount of the anionic polymer composite emulsion comprising wax and the cationic polymer composite emulsion comprising colorant can refer to the corresponding ratio of wax to colorant in the art, and 1:1 by weight is preferable.

In a class of this embodiment, the wax is a low molecular weight of polyethylene wax, low molecular weight of polypropylene wax, or low molecular weight of copolyolefin wax; a hydrocarbon wax, such as paraffin or microcrystalline wax; docosanoic acid docosyl ester; stearic acid stearyl; a natural wax, such as carnauba wax and beeswax; or a higher fatty acid amide, such as oleic acid amide and stearic amide.

In a class of this embodiment, the colorant is an inorganic pigment, an organic pigment, an organic dye, or a mixture thereof. For example, cyan colorants: C.I. pigment blue 15:3, pigment blue 15:4, etc.; yellow colorants: C.I. pigment yellow 74, pigment yellow 93, pigment yellow 94, pigment yellow 155, solvent yellow 162, pigment yellow 180, pigment yellow 185, etc.; magenta colorants: C.I. pigment red 31, pigment red 122, pigment red 150, pigment red 184, pigment red 185, pigment red 57:1, pigment red 238, pigment red 269 etc; black colorants: carbon black, magnetite, etc.

In a class of this embodiment, the monomer is styrene, α-methyl styrene, ethyl acrylate, n-butyl acrylate, isobutyl acrylate, tert-butyl acrylate, n-hexyl acrylate, 2-ethylhexyl acrylate, dodecyl acrylate, methyl methacrylate, ethyl methacrylate, n-butyl methacrylate, isobutyl methacrylate, tert-butyl methacrylate, n-hexyl methacrylate, 1,3-butadiene, or 1,2-butadiene, and particularly styrene or butyl acrylate. A polar monomer is acrylic acid, methacrylic acid, fumaric acid, maleic acid, crotonic acid, or itaconic acid, and particularly acrylic acid or methacrylic acid.

In a class of this embodiment, the cationic surfactant is an amine salt surfactant, a quaternary ammonium surfactant, or a mixture thereof. The amine salt surfactant is selected from the group consisting of a primary amine salt surfactant, secondary amine salt surfactant, tertiary amine salt surfactant, hydroxyl amine, diamine, polyamine, an amine derivative containing acyl, or a guanidine derivative containing acyl. The quaternary ammonium surfactant is selected from the group consisting of a dodecyl trimethyl ammonium chloride, cetyl trimethyl ammonium chloride, octadecyl trimethyl ammonium chloride, dodecyl dimethyl benzyl ammonium chloride, cetyl dimethyl benzyl ammonium chloride, octadecyl dimethyl benzyl ammonium chloride, dodecyl trimethyl ammonium bromide, cetyl trimethyl ammonium bromide, octadecyl trimethyl ammonium bromide, dodecyl dimethyl benzyl ammonium bromide, cetyl dimethyl benzyl ammonium bromide, octadecyl dimethyl benzyl ammonium bromide, cetyl dimethyl allyl ammonium chloride, N, N-dimethyl-N-benzyl-3-(stearylamino) propylamine chloride, and dibenzyl-di(stearamide ethyl) ammonium chloride. The quaternary ammonium surfactant is preferable, and alkyl dimethyl benzyl ammonium chloride is more preferable.

In a class of this embodiment, the anionic surfactant is a carboxylate, sulfonate, sulfate, a structure-mixed surfactant, or a mixture thereof, including but not limited to fatty alcohol polyoxyethylene ether carboxylale, sodium stearate, straight chain sodium alkylbenzene sulfonate, branched chain sodium alkylbenzene sulfonate, sodium diisopropyl naphthalene sulfonate, sodium dibutyl naphthalene sulfonate, sodium alkyl sulfonate, sodium α-olefin sulfonate, α-sulfo fatty acid ester, straight chain alkyl sulfate, sodium branched-chain alkyl sulfate, and fatty alcohol polyoxyethylene ether sulfate. Straight chain alkyl sulfate and fatty alcohol polyoxyethylene ether sulfate are preferable.

In a class of this embodiment, the nonionic surfactant is a fatty alcohol polyoxyethylene ether, alkylphenol polyoxyethylene ether, polyoxyethylene carboxylate, alkanolamide, or polyoxyethylene alkanolamide, particularly alkylphenol polyoxyethylene ether, and more particularly alkylphenol polyoxyethylene ether having between 8 and 10 carbon atoms.

In a class of this embodiment, the initiator is a water soluble persulfate, such as potassium persulfate, sodium persulfate, ammonium persulfate, or a redox initiator composed of the above-mentioned persulfate and acid sodium sulfite or ascorbic acid.

Advantages of the invention are summarized below:

1. The color toner is non-spherical with uniform size and shape, not prone to stick to a photoreceptor, easy to recovery and clean, and has good resolution and color upon printing and copying;
2. Upon in situ emulsion polymerization, a high frequency eddy current is formed using the impinging stream mixer so that the anionic polymer composite emulsion comprising wax and the cationic polymer composite emulsion comprising colorant are agglutinated by the interaction of positive charge and negative charge, in which no flocculant is needed, so the method is simple and easy for practice; and
3. The ball effect of silica reduces the melt viscosity of toner upon printing and copying, which is beneficial to improve resolution and color.

DETAILED DESCRIPTION OF THE EMBODIMENTS

For further illustrating the invention, experiments detailing a method of preparing a color toner and the color toner prepared by the method are described below. It should be noted that the following examples are intended to describe and not to limit the invention.

EXAMPLE 1

Preparation of Anionic Polymer Composite Emulsion 1 Comprising Wax

Preparation of Wax Dispersion 30 g of wax (docosanoic acid docosyl ester), 7.5 g of sodium dodecyl sulfate, and 62.5 g of water were stirred for dissolution at 90° C. The resultant mixture was quickly added to a high-speed dispersant for dispersion for 2 hrs. A milk white wax dispersion with a particle size of 150 nm was obtained. The particle size was measured using Beckman Coulter LS230 instrument.

Preparation of Anionic Polymer Composite Emulsion Comprising Wax 5 g of sodium dodecyl sulfate was dissolved in 100 g of water. The solution was added to a polymerization reactor. Subsequently, 25 g of the wax dispersion and 1.4 g of surface-treated nano-silica (Degussa R972, particle size of 10-14 nm) were put into the reactor respectively. The reactor was heated to 75° C., and a solution prepared by dissolving 1 g of potassium persulfate in 50 g of water was added. Further, a mixture comprising 75 g of styrene, 22 g of butyl acrylate, 3 g of methacrylic acid, and 2 g of dodecyl mercaptan was added to the reactor gradually within 2 hrs. After that, the reactor was heated to 80° C. and maintained for 3 hrs to yield an anionic polymer composite emulsion comprising wax and with a particle size of 230 nm, which was referred to as composite emulsion A-1. The particle size was measured using a nano particle size analyzer.

EXAMPLE 2

Preparation of Anionic Polymer Composite Emulsion 2 Comprising Wax

Preparation of Wax Dispersion

The same as that in Example 1.

Preparation of Anionic Polymer Composite Emulsion Comprising Wax 6 g of sodium dodecyl sulfate was dissolved in 100 g of water. The solution was added to a polymerization reactor. Subsequently, 25 g of the wax dispersion and 14 g of surface-treated nano-silica (Degussa R974, particle size of 10-14 nm) were put into the reactor respectively. The reactor was heated to 75° C., and a solution prepared by dissolving 1 g of potassium persulfate in 50 g of water was added. Further, a mixture comprising 75 g of styrene, 22 g of butyl acrylate, 3 g of methacrylic acid, and 2 g of dodecyl mercaptan was added to the reactor gradually within 2 hrs. After that, the reactor was heated to 80° C. and maintained for 3 hrs to yield an anionic polymer composite emulsion comprising wax and with a particle size of 225 nm, which was referred to as composite emulsion A-2.

EXAMPLE 3

Preparation of Anionic Polymer Composite Emulsion 3 Comprising Wax

The preparation method was the same as that in Example 1 except that dodecyl mercaptan was substituted with n-octyl mercaptan and the usage amount of nano-silica was 5 g instead of 1.4 g. An anionic polymer composite emulsion comprising wax and with a particle size of 228 nm was obtained, which was referred to as composite emulsion A-3.

EXAMPLE 4

Preparation of Anionic Polymer Composite Emulsion 4 Comprising Wax

The preparation method was the same as that in Example 2 except that methacrylic acid was substituted with acrylic acid. An anionic polymer composite emulsion comprising wax and with a particle size of 220 nm was obtained, which was referred to as composite emulsion A-4.

EXAMPLE 5

Preparation of Cationic Polymer Composite Emulsion 1 Comprising Colorant

Preparation of Colorant Dispersion 30 g of carbon black (manufactured by Cabot Co., Ltd.), 7.5 g of dodecyl trimethyl ammonium chloride, and 62.5 g of water were mixed and stirred at room temperature for pre-dispersion. The resultant mixture was added to a high-speed dispersant for dispersion for 2 hrs. A pigment dispersion with particle size of 120 nm was obtained.

Preparation of Cationic Polymer Composite Emulsion Comprising Colorant 5 g of dodecyl trimethyl ammonium chloride was dissolved in 100 g of water. The solution was added to a polymerization reactor. Subsequently, 25 g of the pigment dispersion and 1.4 g of surface-treated nano-silica (Degussa R972, particle size of 10-14 nm) were put into the reactor respectively. The reactor was heated to 75° C., and a solution prepared by dissolving 1 g of potassium persulfate in 50 g of water was added. Further, a mixture comprising 75 g of styrene, 22 g of butyl acrylate, 3 g of methacrylic acid, and 2 g of dodecyl mercaptan was added to the reactor gradually within 2 hrs. After that, the reactor was heated to 80° C. and maintained for 3 hrs to yield a cationic polymer composite emulsion comprising colorant and with a particle size of 243 nm, which was referred to as composite emulsion B-1.

EXAMPLE 6

Preparation of Cationic Polymer Composite Emulsion 2 Comprising Colorant

Preparation of Colorant Dispersion

The same as that in Example 5.

Preparation of Cationic Polymer Composite Emulsion Comprising Colorant 6 g of cetyl trimethyl ammonium chloride was dissolved in 100 g of water. The solution was added to a polymerization reactor. Subsequently, 25 g of the colorant dispersion and 14 g of surface-treated nano-silica (Degussa R972, particle size of 10-14 nm) were put into the reactor respectively. The reactor was heated to 75° C., and a solution prepared by dissolving 1 g of potassium persulfate in 50 g of water was added. Further, a mixture comprising 75 g of styrene, 22 g of butyl acrylate, 3 g of methacrylic acid, and 2 g of dodecyl mercaptan was added to the reactor gradually within 2 hrs. After that, the reactor was heated to 80° C. and maintained for 3 hrs to yield a cationic polymer composite emulsion comprising colorant and with a particle size of 250 nm, which was referred to as composite emulsion B-2.

EXAMPLE 7

Preparation of Cationic Polymer Composite Emulsion 3 Comprising Colorant

The preparation method was the same as that in Example 5 except that carbon black was substituted with pigment yellow 155 and the usage amount of nano-silica was 5 g instead of 1.4 g. A cationic polymer composite emulsion comprising colorant and with a particle size of 215 nm was obtained, which was referred to as composite emulsion B-3.

EXAMPLE 8

Preparation of Cationic Polymer Composite Emulsion 4 Comprising Colorant

The preparation method was the same as that in Example 6 except that carbon black was substituted with pigment red 184. A cationic polymer composite emulsion comprising colorant and with a particle size of 235 nm was obtained, which was referred to as composite emulsion B-4.

EXAMPLE 9

Preparation of Cationic Polymer Composite Emulsion 5 Comprising Colorant

The preparation method was the same as that in Example 5 except that carbon black was substituted with pigment blue 15:4. A cationic polymer composite emulsion comprising colorant and with a particle size of 240 nm was obtained, which was referred to as composite emulsion B-5.

EXAMPLE 10

Preparation of Toner 1

100 g of the composite emulsion A-1 was added to a reactor and stirred at 500 rpm, and with stirring 100 g of the composite emulsion B-1 was added gradually to the reactor within 20 min. The mixture was stirred for 30 min and then heated to 60° C. in another 30 min. The stir speed was decreased to 200 rpm, and the particle size of polymer in the system was measured. When the particle size was up to 7 μm, the nonionic surfactant X-405 (Dow Chemical) was added. Meanwhile, the stir speed was increased to 400 rpm and the temperature was increased to 95° C. When the sphericity of the polymer particle was more than 0.96 (measured using FPIA-3000), the particle was cooled, filtered using a centrifuge, washed with water, and dried with vacuum heating. Subsequently, an additive was added to the dried particle to yield a toner named toner T-1.

EXAMPLE 11

Preparation of Toner 2

The preparation method was the same as that in Example 10 except that the composite emulsion B-1 was substituted with the composite emulsion B-2 and the nonionic surfactant X-405 was substituted with lauryl polyoxyethylene ether to yield a toner named toner T-2.

EXAMPLE 12

Preparation of Toner 3

5,000 g of the composite emulsion A-1 was added to an impinging stream mixer (manufactured by Changchun Leeya Water Treatment Tech Co., Ltd.) whose impinging speed was controlled at 450 mL/s, and with stirring 5,000 g of the composite emulsion B-3 was added gradually to the mixer within 20 min. The solution was mixed for 30 min. The impinging speed was decreased to 300 mL/s and the mixture was heated to 95° C. within 120 min. The particle size of polymer in the system was measured. When the particle size was up to 7 μm, the nonionic surfactant X-405 (Dow Chemical) was added. Meanwhile, the impinging speed was increased to 520 mL/s. 30 min later, the particle size and the sphericity (measured using FPIA-3000) were measured. When the sphericity of the polymer particle was more than 0.96, the particle was cooled, filtered using a centrifuge, washed with water, and dried with vacuum heating. Subsequently, an additive was added to the dried particle to yield a toner named toner T-3.

EXAMPLE 13

Preparation of Toner 4

The preparation method was the same as that in Example 10 except that the composite emulsion B-1 was substituted with the composite emulsion B-4 to yield a toner named toner T-4.

EXAMPLE 14

Preparation of Toner 5

The preparation method was the same as that in Example 10 except that the composite emulsion B-1 was substituted with the composite emulsion B-5 to yield a toner named toner T-5.

EXAMPLE 15

Preparation of Toner 6

The preparation method was the same as that in Example 10 except that the composite emulsion A-1 was substituted with the composite emulsion A-2 to yield a toner named toner T-6.

EXAMPLE 16

Preparation of Toner 7

The preparation method was the same as that in Example 10 except that the composite emulsion A-1 was substituted with the composite emulsion A-3 to yield a toner named toner T-7.

EXAMPLE 17

Preparation of Toner 8

The preparation method was the same as that in Example 10 except that the composite emulsion A-1 was substituted with the composite emulsion A-4 to yield a toner named toner T-8.

EXAMPLE 18

Preparation of Toner 9

The preparation method was the same as that in Example 12 except that the composite emulsion A-1 was substituted with the composite emulsion A-2 to yield a toner named toner T-9.

EXAMPLE 19

Preparation of Toner 10

The preparation method was the same as that in Example 13 except that the composite emulsion A-1 was substituted with the composite emulsion A-2 to yield a toner named toner T-10.

EXAMPLE 20

Preparation of Toner 11

The preparation method was the same as that in Example 14 except that the composite emulsion A-1 was substituted with the composite emulsion A-2 to yield a toner named toner T-11.

EXAMPLE 21

Preparation of Toner 12

The preparation method was the same as that in Example 12 except that the composite emulsion A-1 was substituted with the composite emulsion A-3 to yield a toner named toner T-12.

The properties of the toner of Examples have been tested, and the results are listed below:

| Properties | Particle size | Sphericity | Development density | Bottom ash | Waste rate | Consumption (mg) | Resolution (line pair/mm) |
|---|---|---|---|---|---|---|---|
| Toner T-1 | 6.452 | 0.966 | 1.35 | 0.001 | 7% | 20 | 6 |
| Toner T-2 | 7.585 | 0.953 | 1.34 | 0.003 | 10% | 29 | 12 |
| Toner T-3 | 6.268 | 0.972 | 1.3 | 0.001 | 12% | 25 | 6 |
| Toner T-4 | 6.574 | 0.980 | 1.47 | 0.002 | 8% | 27 | 12 |
| Toner T-5 | 6.646 | 0.958 | 1.45 | 0.003 | 5% | 28 | 12 |
| Toner T-6 | 6.892 | 0.965 | 1.39 | 0.004 | 9% | 22 | 12 |
| Toner T-7 | 6.258 | 0.962 | 1.41 | 0.003 | 6% | 24 | 6 |
| Toner T-8 | 6.068 | 0.964 | 1.42 | 0.005 | 8% | 28 | 6 |
| Toner T-9 | 7.685 | 0.943 | 1.38 | 0.008 | 7% | 22 | 6 |
| Toner T-10 | 6.150 | 0.981 | 1.37 | 0.003 | 10% | 21 | 6 |
| Toner T-11 | 6.423 | 0.982 | 1.40 | 0.004 | 11% | 23 | 12 |
| Toner T-12 | 6.635 | 0.954 | 1.42 | 0.001 | 6% | 24 | 6 |

Conclusion: The test results show that the toner of the invention has high development density, high resolution, low bottom ash, low waste rate, and low consumption.

While particular embodiments of the invention have been shown and described, it will be obvious to those skilled in the art that changes and modifications may be made without departing from the invention in its broader aspects, and therefore, the aim in the appended claims is to cover all such changes and modifications as fall within the true spirit and scope of the invention.

The invention claimed is:

1. A method of preparing a color toner, comprising:

a) preparing an anionic polymer composite emulsion comprising wax with a wax particle and nano-silica as core by in situ emulsion polymerization;

b) preparing a cationic polymer composite emulsion comprising colorant with a colorant and nano-silica as core by in situ emulsion polymerization;

c) agglutinating said anionic polymer composite emulsion comprising wax and said cationic polymer composite emulsion comprising colorant; and d) optionally, filtering, washing, and drying the product obtained in c).

2. The method of claim 1, further comprising adding an additive to the dried product.

3. The method of claim 1, wherein said anionic polymer composite emulsion comprising wax and said cationic polymer composite emulsion comprising colorant are mixed using an impinging stream mixer and agglutinated under the interaction of positive charge and negative charge.

4. The method of claim 1, wherein said anionic polymer composite emulsion comprising wax is prepared in the presence of an anionic surfactant.

5. The method of claim 1, wherein said cationic polymer composite emulsion comprising colorant is prepared in the presence of a cationic surfactant.

6. The method of claim 1, wherein said anionic polymer composite emulsion comprising wax and said cationic polymer composite emulsion comprising colorant are agglutinated in the presence of a nonionic surfactant.

7. The method of claim 1, wherein a particle size of said nano-silica is between 10 and 100 nm.

8. The method of claim 1, wherein a usage amount of said nano-silica is between 0.5 and 5 wt. % of said anionic polymer composite emulsion comprising wax or between 0.5 and 5 wt. % of said cationic polymer composite emulsion comprising colorant.

* * * * *